US006233980B1

(12) United States Patent
Kegler et al.

(10) Patent No.: US 6,233,980 B1
(45) Date of Patent: May 22, 2001

(54) DRY CLEANING VESSEL DOOR OPENING APPARATUS WITH SELF-ALIGNING AND REDUCED STRESS LOCKING LUGS

(76) Inventors: Andrew F. Kegler, 547 Eureka St., Ripon, WI (US) 54971; Stephen L. Harris, 365 Westbrook Dr.; Gregory L. Malchow, 1903 Scarlet Oak Trail, both of Oshkosh, WI (US) 54904; Charles Becht, 22 Church St., Liberty Corners, NJ (US) 07938

( * ) Notice: Subject to any disclaimer, the term of this patent is extended or adjusted under 35 U.S.C. 154(b) by 0 days.

(21) Appl. No.: 09/338,591

(22) Filed: Jun. 23, 1999

(51) Int. Cl.[7] ..... D06F 43/02; D06F 37/28
(52) U.S. Cl. ..... 68/139; 68/196; 68/210
(58) Field of Search ..... 68/139, 196, 210; 34/596, 601; 134/159, 200; 220/812

(56) References Cited

U.S. PATENT DOCUMENTS 2,639,601 * 5/1953 Miller ..... 68/210 X
3,498,089 * 3/1970 Miller et al. ..... 68/139
4,217,920 * 8/1980 Ballard ..... 134/200 X
4,964,228 * 10/1990 Coffman ..... 34/601 X
5,357,772 * 10/1994 Hendren ..... 68/210

* cited by examiner

*Primary Examiner*—Philip R. Coe
(74) *Attorney, Agent, or Firm*—Leydig, Voit & Mayer, Ltd.

(57) ABSTRACT

A liquified gas dry-cleaning machine having a cleaning vessel with a chamber for containing a wash bath and items to be cleaned, a removable door for sealing the cleaning chamber during a dry-cleaning operation, and a locking ring for retaining the door in closed position. A door opening and closing apparatus is provided which includes a pivot frame for moving the door in an arced path of movement into and out of closed position with the cleaning vessel. The door and locking ring have respective locking lugs with a specifically designed geometry for enabling arced movement of the door into and out of the closed position and for centering the door in aligned relation to the cleaning chamber as an incident to such movement. The locking lugs further have mating locking surfaces designed for point contact in a manner that minimizes stress concentrations at n the roots of the locking ring lugs.

35 Claims, 8 Drawing Sheets

DRY CLEANING VESSEL DOOR OPENING APPARATUS WITH SELF-ALIGNING AND REDUCED STRESS LOCKING LUGS

FIELD OF THE INVENTION

The present invention relates generally to pressurized liquid cleaning systems, and more particularly, to an apparatus for opening and closing an access door to a high pressure cleaning vessel used in such systems.

BACKGROUND OF THE INVENTION

Known dry-cleaning processes consist of a wash, rinse, and drying cycle with solvent recovery. Garments are loaded into a basket in a cleaning drum and immersed in a dry-cleaning fluid or solvent, which is pumped into the cleaning drum from a base tank. Conventional dry-cleaning fluids include perchloroethylene (PCE), petroleum-based or Stoddard solvents, CFC-113, and 1,1,1-trichloroethane, all of which are generally aided by a detergent. The solvent is used to dissolve soluble contaminants, such as oils, and to entrain and wash away insoluble contaminants, such as dirt.

The use of these conventional solvents, however, poses a number of health and safety risks as well as being environmentally hazardous. For example, halogenated solvents are known to be environmentally unfriendly, and at least one of these solvents, PCE, is a suspected carcinogen. Known petroleum-based solvents are flammable and can contribute to the production of smog. Accordingly, dry cleaning systems which utilize dense phase fluids, such as liquid carbon dioxide, as a cleaning medium have been developed. An apparatus and method for employing liquid carbon dioxide as the dry-cleaning solvent is disclosed in U.S. Pat. No. 5,467,492, entitled "Dry-Cleaning Garments Using Liquid Carbon Dioxide Under Agitation As Cleaning Medium". A similar dry cleaning apparatus is also disclosed in U.S. Pat. No. 5,651,276.

These systems pose a number of other problems, particularly in relation to the high operating pressures necessary for maintaining the gas in a liquid state. For example, the various pressurized components of the system must be constructed with thick, heavy walled structures to withstand the elevated pressures encountered during the dry cleaning operation. These bulky structures can consume a significant amount of space. In order to encourage dry cleaning operators to convert to liquid carbon dioxide dry cleaning systems, these new systems must be configured so as to minimize space consumption. This is necessary to enable such systems to be placed into facilities and locations designed for existing dry-cleaning equipment. Moreover, due to the neighborhood nature of many dry cleaning operations, there can be even greater space limitations. Thus, while minimizing space requirements is always an important object, it is particularly important with dry cleaning equipment.

In terms of space consumption, one of the more critical aspects of a liquifiable gas dry-cleaning apparatus is the area required for opening and closing of the access door of the pressurized cleaning vessel to permit loading and removal of garments or other items for cleaning. Since the cleaning vessel in a liquid carbon dioxide system operates at a high pressure (e.g. 700–850 psi) under ambient temperature conditions in order to ensure that the carbon dioxide remains in a liquid phase, a relatively bulky, heavy walled door must be used. One type of door which could be used on such a liquid carbon dioxide cleaning vessel is a conventional hinged door. Due to the weight of the door, an opening mechanism typically would have to be provided for swinging the door to an open position at the side of the cleaning vessel. However, with such a hinged door a significant amount of clearance would have to be provided both in front of the cleaning vessel, to allow for the swinging motion of the door, and to at least one side of the cleaning vessel. Moreover, additional space would have to be provided for the door opening and closing mechanism.

While the need to minimize space consumption in the front of the cleaning vessel might be satisfied by using a door which could slide horizontally into an open position, clearance again would have to be provided on at least one side of the cleaning vessel to allow for the open door. Additionally, the mechanism for horizontally sliding the door to the open position would have to be arranged to the side of the cleaning vessel and likely would require additional space.

Not only does the bulk and size of the removable door and its opening mechanism consume floor space, they further may impede access to the cleaning chamber when the door is opened. Moreover, if any part of the door or its opening mechanism is moved to a position in front of the cleaning vessel as a result of the door opening operation, it can extend the axial reach necessary for an operator to manually reach into the cleaning chamber to load or unload items therein.

Hence, the need exists in the art for a door opening and closing mechanism for such pressurized cleaning vessels that can be operated with minimal space requirements. Due to the bulk and weight of the door, and the necessity for manipulating the door within relatively small space constraints, it further has been difficult to quickly and reliably move and lock the door in precise aligned relation with the pressure vessel. Moreover, heretofore if the door opening and closing mechanism did not move the door with straight axial movement into and out of engagement with the pressure vessel, difficulties could result in properly engaging locking elements necessary for securing the door. High stress concentrations also can occur to the locking elements during usage which can cause metal fatigue and failure.

OBJECTS AND SUMMARY OF THE INVENTION

Accordingly, it is an object of the invention to overcome the problems associated with the use of conventional doors and door opening mechanisms on high pressure cleaning vessels for liquified gas dry-cleaning systems.

A more specific object of the invention is to provide an apparatus for opening and closing a door to a high pressure liquified gas cleaning vessel which requires minimal clearance space for operation and which does not necessitate that the door be moved in a straight axial path into and out of position with the pressure vessel.

Another object is to provide a door opening apparatus as characterized above which has a locking arrangement effective for guiding the door into properly aligned position with the pressure vessel during a door closing cycle.

A further object is to provide a door operating apparatus of the foregoing type in which the door and locking ring have inter-engaging locking lugs that are designed to accommodate pivotal or arced movement of the door into and out of mounted position with the pressure vessel.

Yet another object is to provide such a door opening apparatus in which the door and locking element lugs inter-engage in a manner that minimizes high stress concentrations, metal fatigue and failure.

These and other features and advantages of the invention will be more readily apparent upon reading the following description of a preferred exemplary embodiment of the invention and upon reference to the accompanying drawings wherein:

Figure 1:
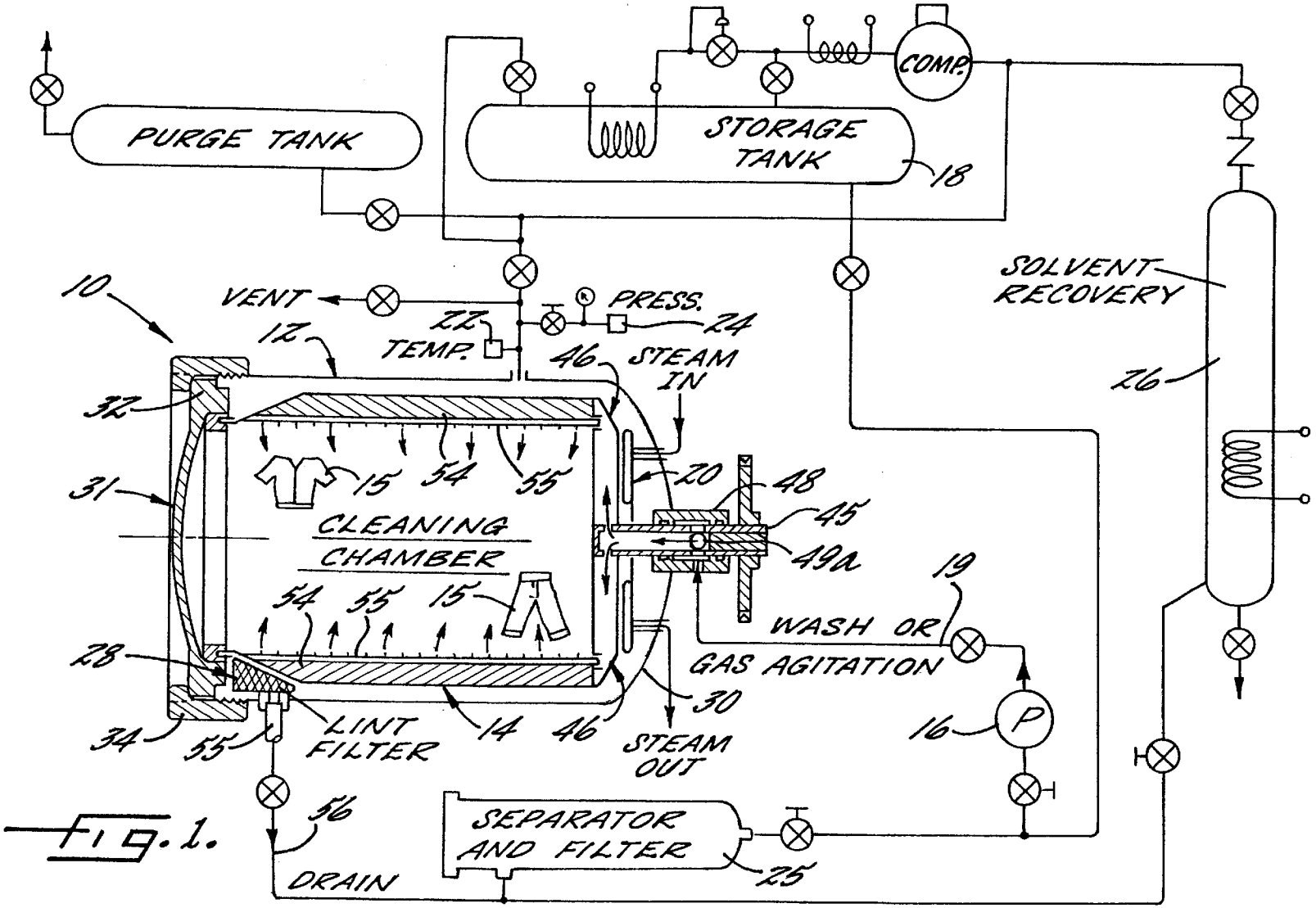
FIG. 1 is a schematic of an illustrative liquified gas dry cleaning machine having a cleaning vessel door opening apparatus in accordance with the invention.

While the invention is susceptible of various modifications and alternative constructions, a certain illustrated embodiment thereof has been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE DRAWINGS

Referring now more particularly to FIG. 1 of the drawings, there is shown a diagrammatic depiction of an illustrative liquified gas, dry-cleaning machine 10 embodying the present invention. In general, the dry-cleaning machine 10 includes a cleaning vessel 12 having a basket 14 rotatably disposed therein for containing items 15 to be cleaned. A liquid wash bath derived from a liquifiable gas, such as carbon dioxide, is used as the dry-cleaning solvent. A pump 16 is provided for directing the wash bath from a gas supply storage tank 18 and through an inlet line 19 into the pressure vessel 12. The vessel 12 is equipped with a steam heater 20, pressure sensor 21, and temperature sensor 22 to aid in temperature and pressure control for properly maintaining the wash bath in liquid phase during the dry-cleaning cycle.

The basic operation of a liquified gas dry-cleaning system is known in the art, as reflected by U.S. Pat. Nos. 5,651,276, 5,467,492, and 5,651,276, the disclosures of which are incorporated herein by reference. After the basket 14 is loaded with items, such as garments, for cleaning, the pump 16 charges the vessel 12 with a wash bath drawn from the storage tank 18, which functions as the cleaning solvent during a drying cycle. Upon completion of the dry cleaning cycle, the wash bath is drained from the cleaning vessel and remaining wash bath vapors evacuated and re-liquified by an appropriate condenser for return to the storage tank.

For separating contaminants from the wash bath liquid following a cleaning cycle, the wash bath is cycled through a filtration and separator system 25 which functions to filter and vaporize the wash bath, thereby concentrating the particulate matter and other contaminants. The gaseous vapor is re-liquified in a condenser 26 for return to the storage tank 18. The pressure vessel 12 in this instance includes an internal lint filter 28 for removing lint and course solids from the wash bath as it is drained from the pressure vessel, as disclosed in commonly assigned application Ser. No. Ser. No. 09/338,653, filed Jun. 23, 1999, the disclosure of which is incorporated herein by reference.

Figure 2:
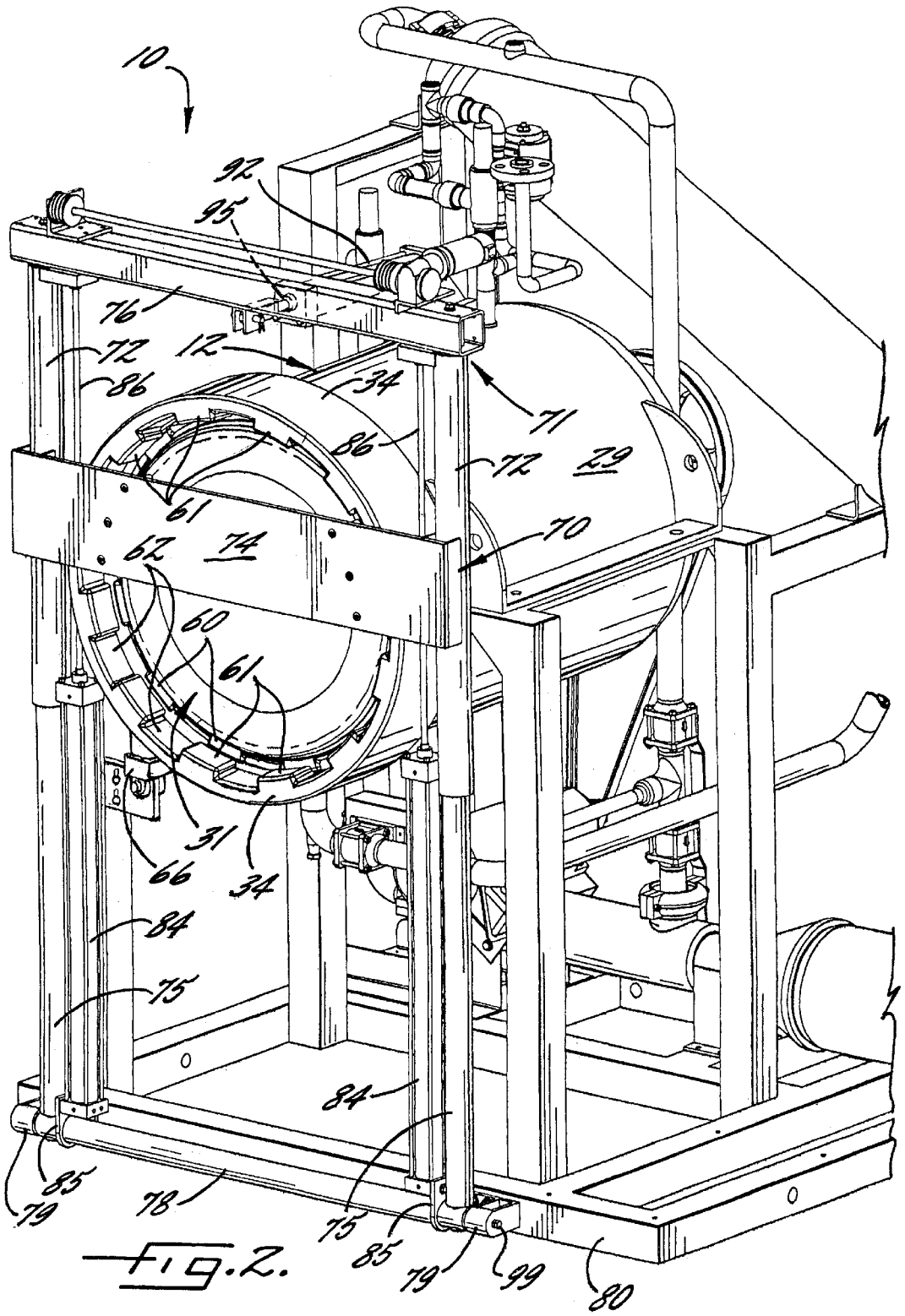
FIG. 2 is a perspective of the illustrated liquified gas dry-cleaning machine depicted in FIG. 1.

The illustrated cleaning vessel 12, as best depicted in FIG. 2 comprises an elongated housing 29 having a rounded end wall 30 integrally formed at one end and a removable door 31, also of generally rounded configuration, releasably secured at the other end. The housing 29 defines a cylindrical cleaning chamber within which the rotary basket 14 is disposed. The removable door 31 has an outer annular retaining flange 32 secured in abutting relation to the end of the housing 29 by means of a locking ring 34 threadedly engaging the end of the housing 29. An annular seal 37 is retained about the door by a retainer plate 38 which is screwed to the door and defines an innermost annular face of the door when in a closed position (FIG. 4). The annular seal 37 includes a C-shaped flexible member 37*a* opening toward the pressure vessel and annular spring 37*b* for maintaining opposed legs of the member 37*a* in sealing contact with the door and cleaning vessel during start up of the machine. As pressure increases within the cleaning chamber, the sealing legs of the C-shaped member 37*a* are urged into high pressure sealing engagement with the door and cleaning vessel.

The basket 14 for receiving and containing items to be cleaned is substantially coextensive in length with the housing 29 and has an outer cylindrical perforated sleeve 36 for enabling circulation of the liquid wash bath through the basket 14 during wash and rinse cycles. The perforated sleeve 36 is secured between a perforated back plate 39 and a front member 40 that defines a central inlet opening to the basket 14 when the door 31 is opened.

For supporting the basket 14 for rotating movement relative to the cleaning vessel 12, the basket 14 has an outwardly extending support and drive shaft 45 extending through the pressure vessel end wall 30 and a spider-configured trunion 46 fixed to the shaft 45 and back plate 39. The drive shaft 45, which preferably is reversibly driven by a bi-directional motor 47, is rotatably supported in an annular collar or bushing 48 affixed in outstanding relation to the end wall 30 of the cleaning vessel. For supporting the opposite end of the basket 14 for rotational movement when the door 31 is in a closed position, the front member 40 terminates in an annular ring 49 that is received and supported within a groove of an annular pilot plate 51 fixed within an annular recess of door 31 on the inner side thereof (FIG. 4).

For agitating items contained within the cleaning chamber and wash bath and for enhancing removal of solid particulate material from the items during a dry cleaning cycle, the basket 14 has a plurality of longitudinal mixing baffles 54, oriented parallel to the rotary axis of the basket, which each support a gas jet manifold 55 formed with a plurality of axially spaced, discharge orifices or nozzles 56, as disclosed in commonly assigned application Ser. No. 09/338,292, filed Jun. 23, 1999, disclosure of which also is incorporated herein by reference. Liquified gas is directed from the storage tank 18 through the bushing 48 and communicates through radial apertures 45*a* in the drive shaft with a shaft passage 56, hollow legs of the trunion 46, and through the manifold tubes 55 for radial direction as pressurized jets or streams of liquified gas into the basket 14 simultaneously with rotation of the basket 14. Following the dry-cleaning cycle, the liquid wash bath is drained from the cleaning vessel 14 through a drain 55 mounted in the bottom of the pressure vessel housing 29 and directed to the filtration and separator system 25 via a return line 56.

Figure 3:
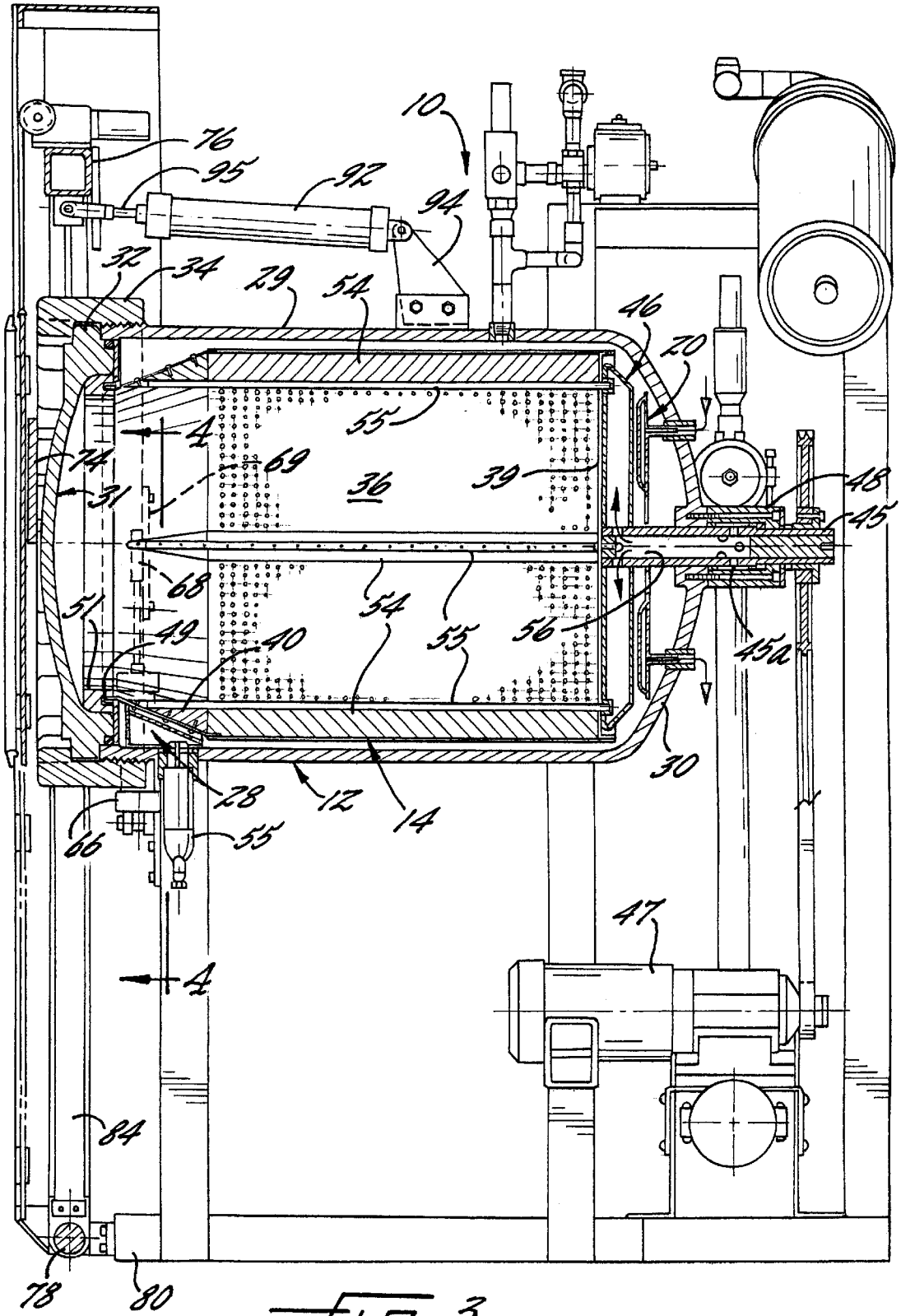
FIG. 3 is an enlarged longitudinal section of the liquified gas dry cleaning machine shown in FIG. 2.
Figure 4A:
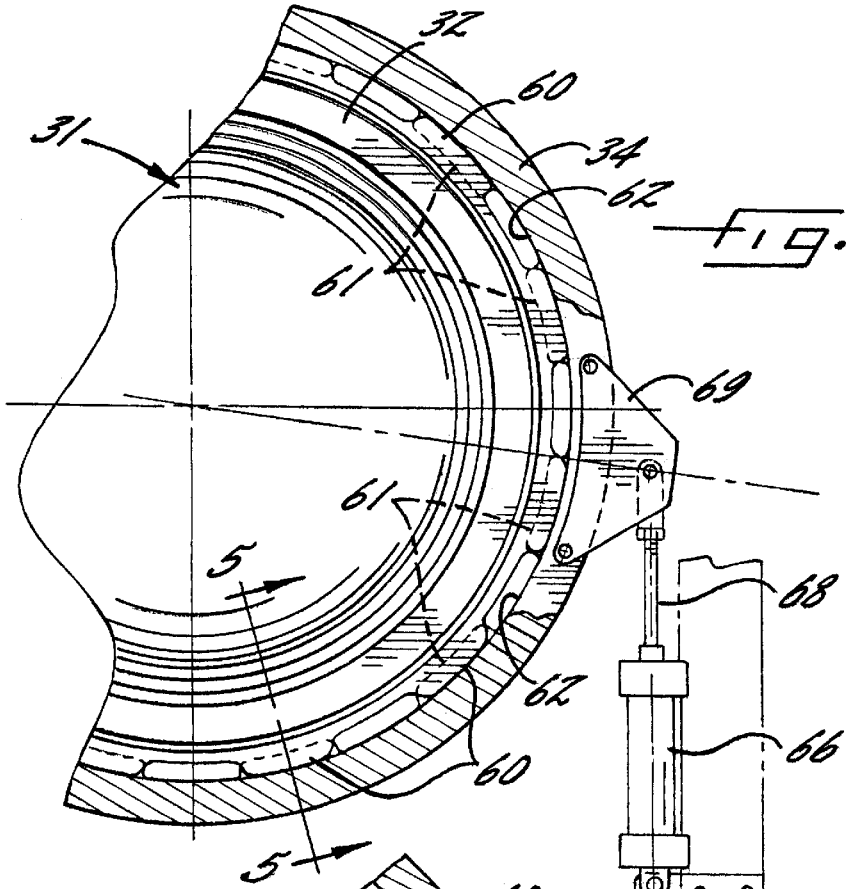
FIG. 4A is an enlarged vertical section taken in the plane of line 3—3 in FIG. 3, showing the cleaning vessel access door locking ring in a locked position.
Figure 4B:
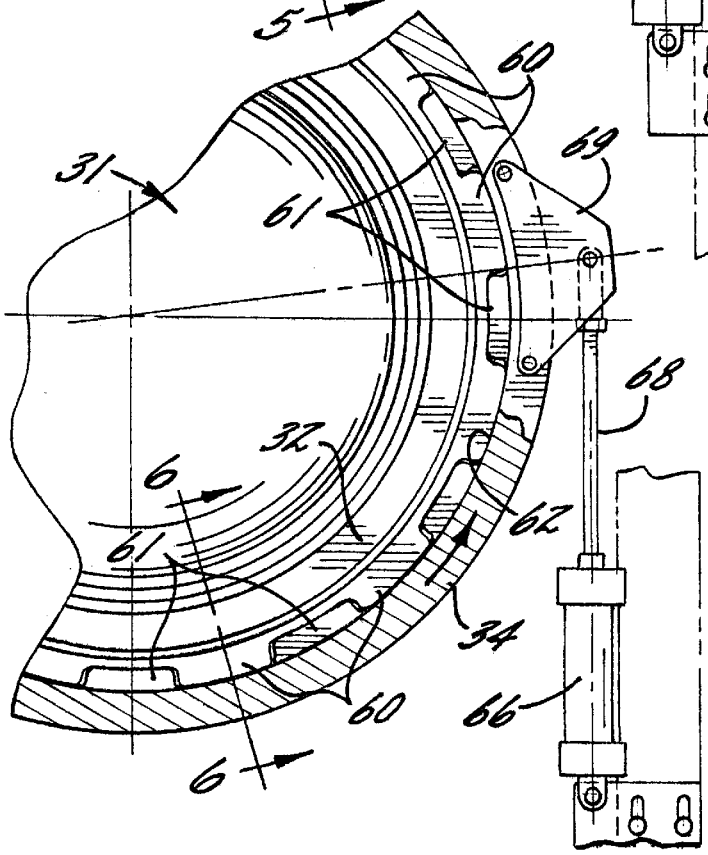
FIG. 4B is an enlarged fragmentary section, similar to FIG. 4A, but showing the door locking ring moved to an opening position.

In order to unlock the door 31 and enable it to be opened following a dry-cleaning cycle, the locking ring 34 is rotatable between locking and unlocked positions (FIGS. 4A and 4B). The door 31 in this instance has a plurality of circumferentially spaced, radially extending locking lugs 60 about its periphery, and the locking ring 34 has a plurality of similarly spaced inwardly extending locking lugs 61 about its periphery which define grooves or recesses 62 which enable passage of the door locking lugs 60 axially inwardly beyond the locking ring lugs 61 as the door is moved to a closed position against the end of the cleaning vessel 12 (FIGS. 3 and 4). The locking ring 34 is then rotatable a small angle for moving the locking ring lugs 61 in juxtaposed relation to the door lugs 60 for retaining the door 31 in mounted position. It will be appreciated that by virtue of the threaded engagement of the locking ring 34 on the cleaning vessel 12, such small 15 rotational movement of the locking ring 34 will axially advance the locking ring 34 a small distance inward on the cleaning vessel, and reverse rotation of the locking ring 34 will retract the locking ring a similar small distance outward. For selectively rotating the locking ring 34 between locked and unlocked positions, a double actuating pneumatic cylinder 66 is affixed at one end to a frame of the dry cleaning machine 10 with its piston rod 68 coupled to a bracket 69 fixed to the locking ring 34, as depicted in FIG. 4A.

With the locking ring 34 rotated to an unlocked position, the door 31 may be moved toward and away from the cleaning vessel during the course of a door closing and opening operation. As indicated above, due to space constraints and the bulk and size of the door, heretofore it has been difficult to quickly or reliably position the door in precise axial alignment with the pressure vessel, particularly if the door is moved in a non-axial path relative to the pressure vessel.

In accordance with the present invention, the locking lugs of the door and locking ring are designed to accommodate non-axial movement of the door into mounted position on the pressure vessel and to automatically and precisely align the door in proper mounted position on the pressure vessel as an incident to such movement. In the illustrated embodiment, for example, the pressure vessel has a door opening and closing apparatus adapted for pivotally moving the door into and out of mounted position along an arc-like path. The illustrated door opening apparatus includes a vertically movable door carrying slide 70, which in turn, is mounted on a pivot frame 71, which together are operable for opening the door by pivotally moving the pivot frame 71 and door carrying slide 70 away from the cleaning vessel 12, lowering the slide 70 to a lower position on the pivot frame 71, and returning the pivot frame 71 to its upright position so as to locate the door 31 in a tucked position below the locking ring 34. The door is returned to its closed position in a basically reverse sequence. Such door closing apparatus is disclosed in U.S. application Ser. No. 09/338,590 filed Jun. 23, 1999, the disclosure of which is incorporated herein by reference.

Basically, the door carrying slide 70 comprises a pair of side sleeves 72 and a cross brace 74 fixed between the side tubes 72 intermediate their ends. The cleaning vessel door 31 is secured to the cross brace on a side thereof facing the cleaning vessel 12. The pivot frame 71 comprises a pair of vertical posts 75 fixed at their upper ends by an upper cross brace beam 76, as depicted in FIGS. 2 and 11–13 The lower ends of the support posts 75 are fixed within a lower pivot shaft 78 which in turn is mounted for relative rotational movement within a bearing bracket 79 fixed to a frame 80 of the machine. The sleeves 72 of the door carrying slide 70 are mounted on the posts 75 for relative sliding movement. Teflon sleeve bushings 81 are fixed within the sleeves 72 to facilitate relative movement.

For selectively moving the slide 70 between raised and lowered positions on the support shafts 75, double actuating pneumatic air cylinders 84 are mounted in adjacent relation to the support shafts 75. The illustrated cylinders 84 are fixed at their lower end to the pivot shaft 78 by a mounting bracket 85 and the cylinder rods 86 thereof each are in threaded engagement with a flange 88 fixed in lateral extending relation to the upper end of the respective sleeve 72. A jam nut 89 secures the cylinder rod 86 in fixed relation to the bracket 88. By appropriate actuation of the cylinders 84, the rods 86 can be extended or retracted to raise and lower the slide 70 and the door 31 mounted thereon between raised and lowered positions. To selectively pivot the pivot frame 71 and the door carrying slide 70 mounted thereon relative to the end of the cleaning vessel 12, a double actuating pneumatic cylinder 92 is fixed at one end to the pressure vessel 12 by a mounting bracket 94 with its piston rod 95 secured to the upper brace 76 of the pivot frame 71.

Figure 5:
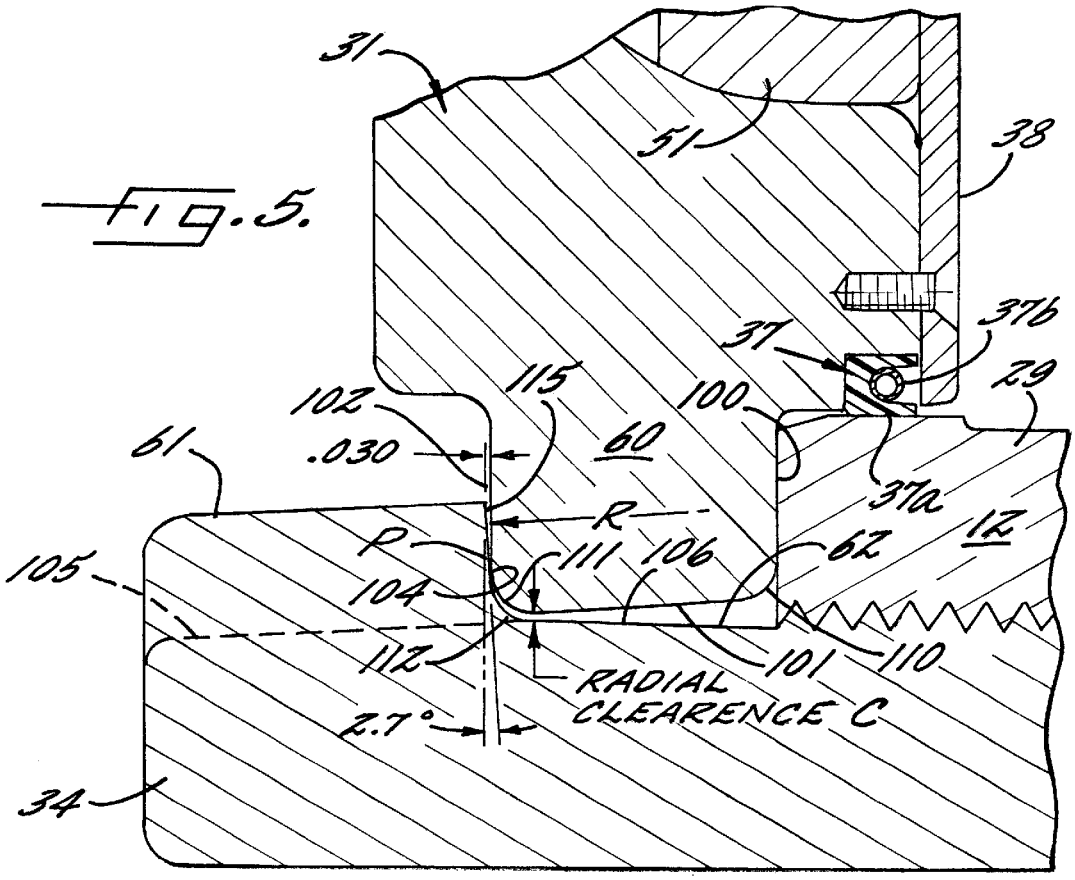
FIG. 5 is an enlarged fragmentary section taken in the plane of line 5—5 in FIG. 4A.
Figure 6:
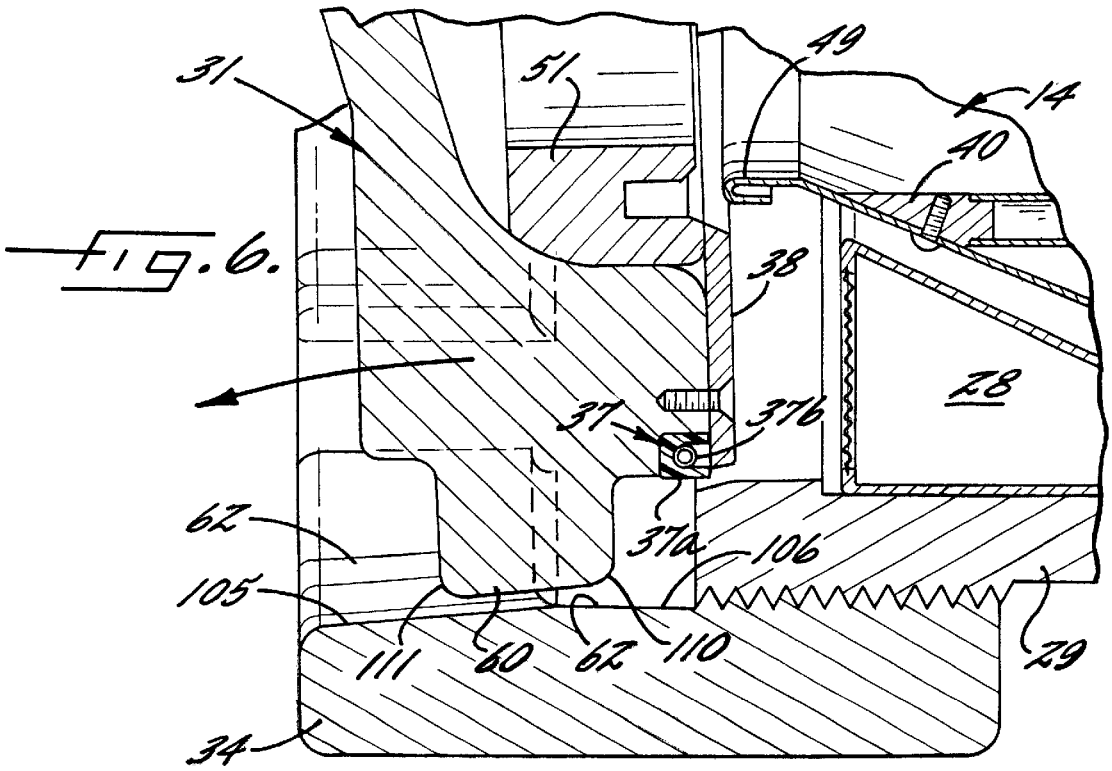
FIG. 6 is an enlarged fragmentary section taken in the plane of line 6—6 in FIG. 4B.
Figure 7:
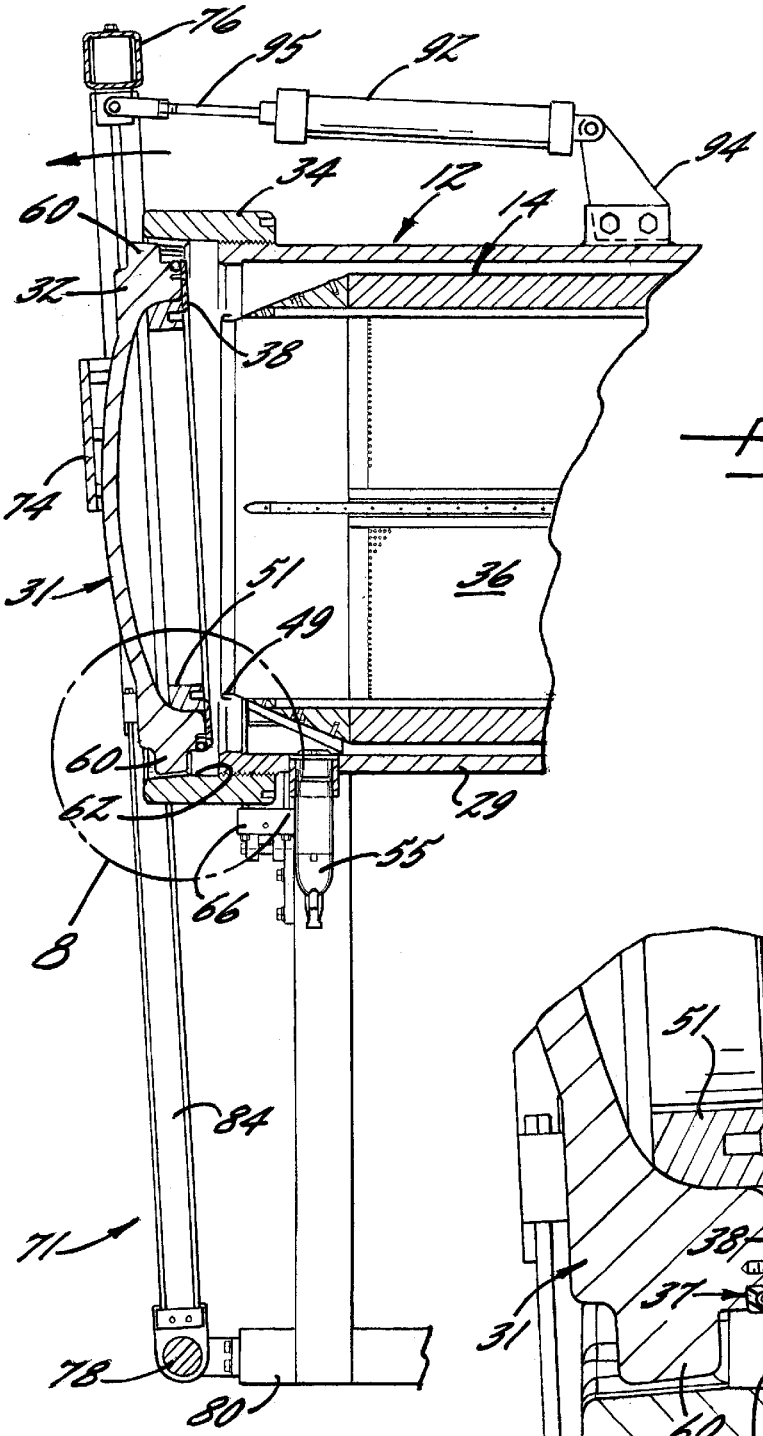
FIG. 7 is a fragmentary vertical section showing the door opening apparatus pivoting the door away from the cleaning vessel.
Figure 8:
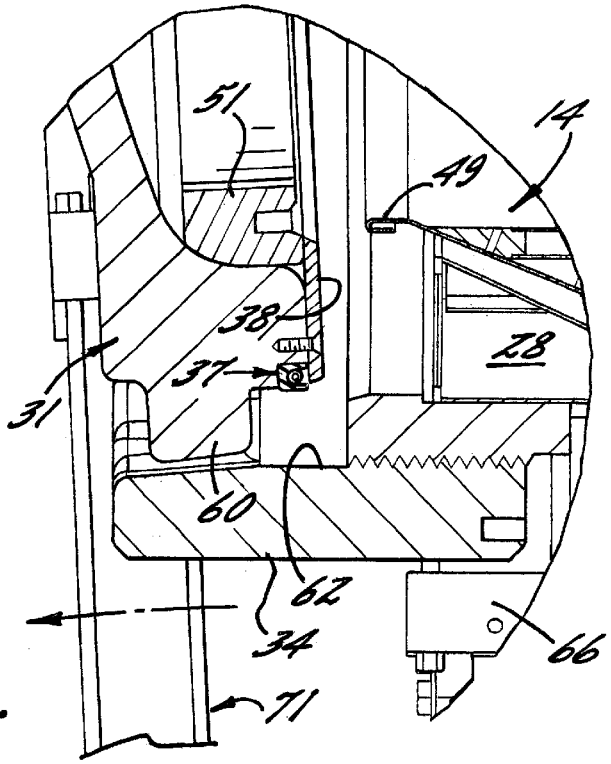
FIG. 8 is an enlarged fragmentary section depicting the encircled area referenced "8" in FIG. 7.
Figure 9:
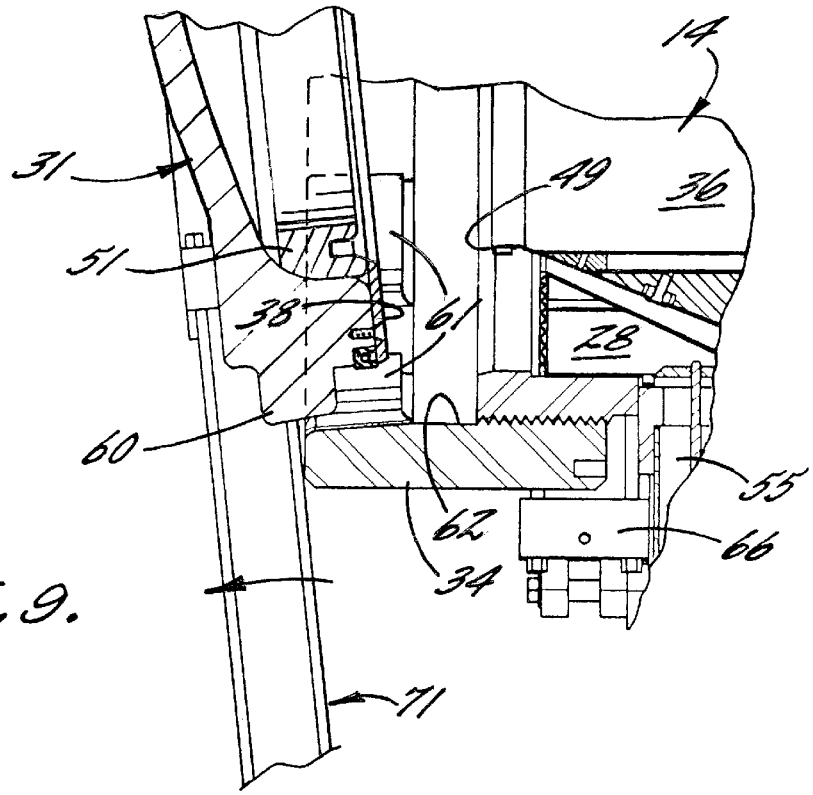
FIGS. 9 and 10 are enlarged fragmentary sections, similar to FIG. 8, showing the door sequentially being moved away from the pressure vessel in an arc-like path.
Figure 10:
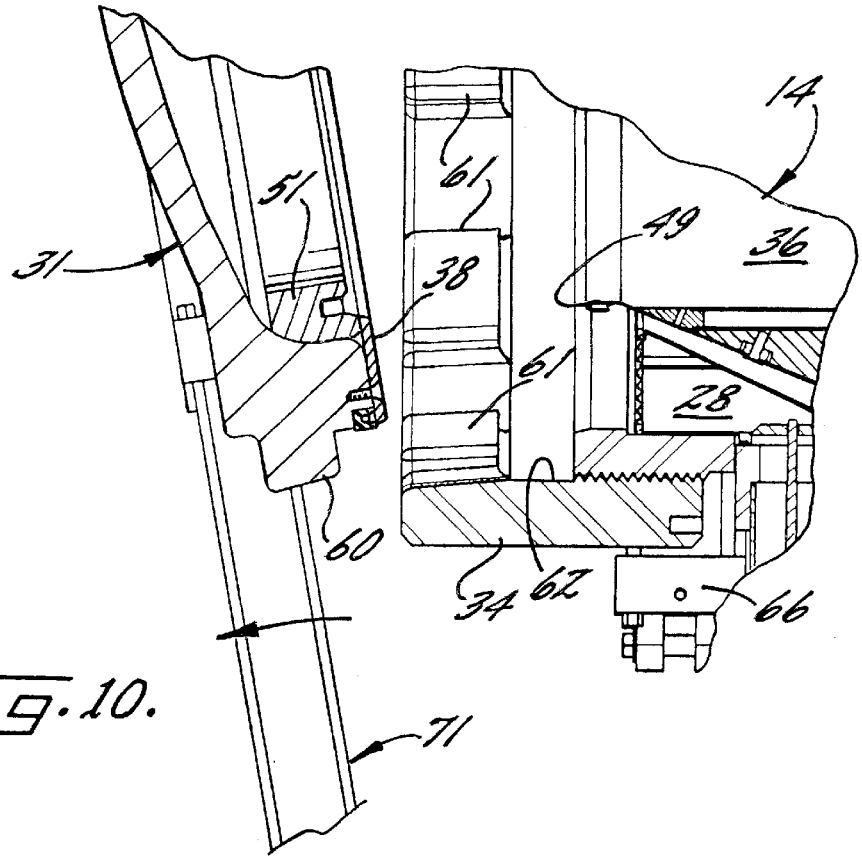
Figure 11:
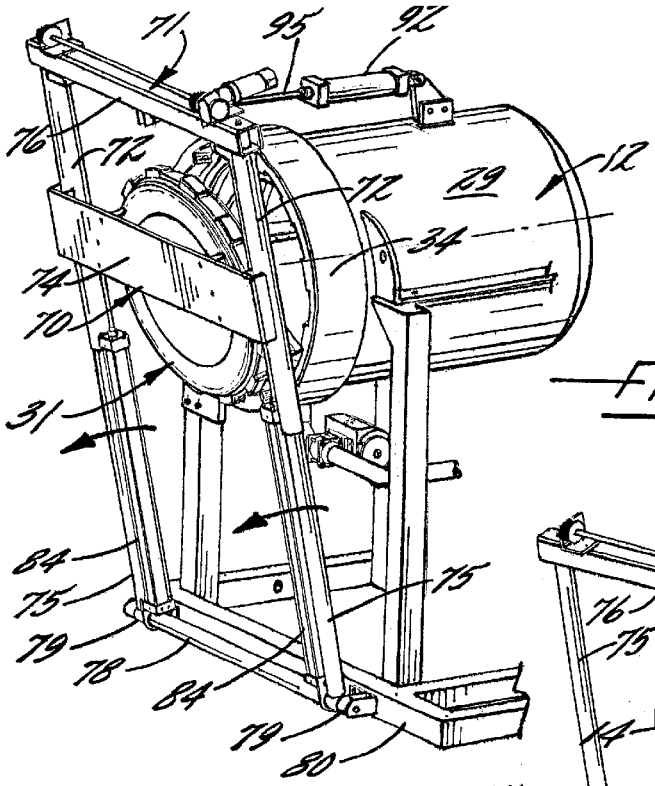
FIGS. 11–13 are perspectives of the illustrative liquified gas dry-cleaning machine sequentially illustrating operation of the door opening apparatus.
Figure 12:
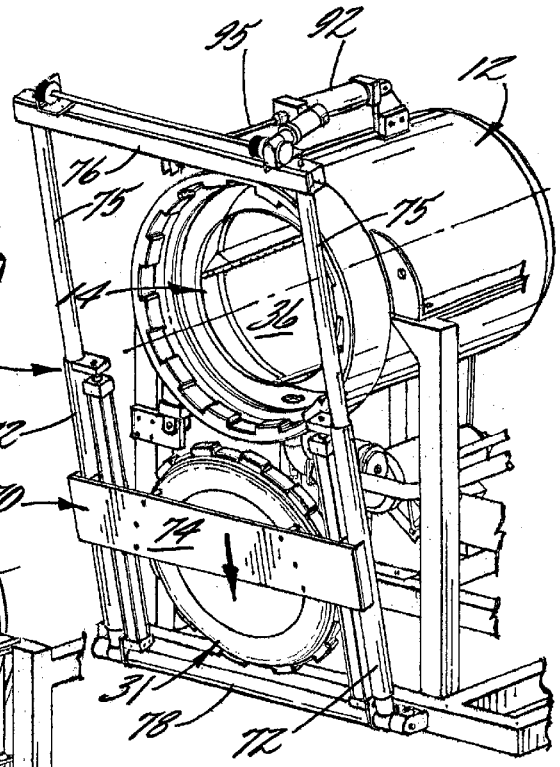
Figure 13:
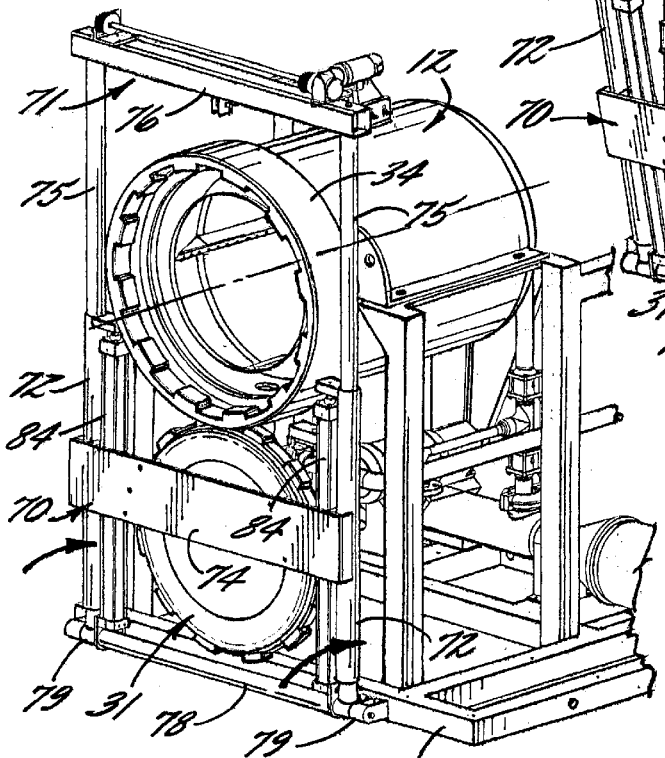

In carrying out the invention, the door locking lugs have conical side surfaces which taper inwardly in the closing direction toward the cleaning vessel and which cooperate with the locking ring to cam the door into final, properly mounted relation adjacent the cleaning vessel. With reference to FIGS. 5 and 6, the door locking lugs 60 each define an abutment surface 100 for engaging the end of the cleaning vessel 12, a side surface 101, and a locking surface 102. The locking ring lugs 61 each define a locking surface 104 operable for engaging a respective locking surface 102 of a door locking lug 60, and the locking ring recesses 62 each define a bottom surface 105, which communicates with an annular door lug seating surface 106 between the locking ring lugs 61 and the end of cleaning vessel 12. The side surfaces 101 of the door locking lugs 60 are conically shaped at an angle of about 5 degrees with respect to the door axis and cooperate with generally similarly tapered surfaces 105 defined by the locking ring recesses 62. As the door 31 is moved into the locking ring 34, the tapered surfaces 101, 105 cooperate to gradually cam and center the door 31 into relatively precise axial orientation with respect to the pressure vessel 12, even though it enters the locking ring 34 along a slightly misaligned or angular path. The tapered surfaces 101, 105 cooperate to locate the door with the locking lugs 60 in fully mounted position with a relatively small clearance "C" of about 0.2 inches at a point in close proximity to the engaging locking surfaces 102, 104 of the door and locking ring. The locking ring seating surface 106 in this case tapers slightly in an opposite direction to that of the door locking lug side surface 101, such as on the order of about 0.5 degrees, so that the door locking lug surface 101 and the locking ring seating surface 106 define a progressively greater clearance area in a direction toward the cleaning vessel, which facilitates easy movement, without interference, of the door into fully mounted position, while still maintaining a relatively small clearance spacing "C".

In further carrying out the invention, in order to additionally accommodate the arc-like or other non-axial movement of the pressure vessel door into operative relation with the locking ring 34 and cleaning vessel 12 during a door closing cycle, the door locking lugs 60 have rounded corners 110, 111, and the locking ring lugs 61 have roots 112 defined by similar sized rounds, which in this case have a radius of 0.25 inches. Such rounded door locking lugs and locking ring roots, together with the tapered surfaces 101, 105, have been found to enable the door 31 to be smoothly and reliably moved into mounted position along an arced, non-axial path, without detrimental interference between the door locking lugs and locking ring.

Pursuant to still a further important feature of the invention, the locking lugs 60, 61 have mating locking surfaces 104, 102 which define a point of contact "P" disposed inwardly in relation to an inner radial tip 115 of the locking ring lugs 61 so as to prevent high stress concentrations, fatigue or metal failure at the locking ring lug roots. The point contact in this case is defined by forming the locking surfaces 102 of the door locking lugs 60 with a gradual radius "R," such as about 24 inches, and by forming the locking surface 104 of the locking ring lugs 61 at a small opening angle, such that the contact point "P" is about midway within the locking surface 104 of the locking ring lug 61 and the locking surfaces 102, 104 define a small clearance angle of about 2.7 degrees opening in a radially outward direction and a clearance space of about 0.03 inches between the tips 115 of the locking ring lugs 61 and the door locking lugs 60. It will be understood by one skilled in the art that by forming the locking lugs 60, 61 with such geometry, the axial forces between the locking lugs will act at about the midpoint of the locking lug surface 104. The resulting smaller moment arm between the contact point and the root 112 of the locking ring lugs 60 substantially minimizes stress concentrations, fatigue and possible failure at the critical root locations.

From the foregoing, it can be seen that the cleaning vessel door opening and closing apparatus of the present invention requires minimal clearance space for operation and does not necessitate that the door be moved in a straight axial path into and out of position with the pressure vessel. The locking lug geometry further is adapted for automatically aligning the door into precise mounted position with the cleaning vessel, and the locking lug elements are engaged in a manner that minimizes high stress concentrations, metal fatigue and failure.

What is claimed is:

1. A dry cleaning machine comprising a cleaning vessel having a chamber for containing a wash bath and items to be cleaned, said cleaning vessel having a removable door, a locking member for retaining said door in a closed position on said cleaning vessel, a cleaning liquid supply for selectively directing a cleaning liquid into said chamber when said door is in said closed position for use during a cleaning cycle, a door opening and closing apparatus for moving said door between said closed position and an open position for enabling items to be loaded into said chamber and removed therefrom said door opening and closing apparatus being operable for moving said door along an arced path away from said cleaning vessel and during return to said closed position, said door and locking member each having respective locking lugs, said locking member being selectively movable between a locking position in which the locking member lugs and door lugs are in aligned juxtaposed relation to each other for preventing movement of said door from said closed position and an unlocked position in which said door and locking member lugs are in offset relation to each other for permitting movement of said door from said closed position, and said locking lugs of at least one of said door and locking member being formed with conical outer side surfaces tapering inwardly in a closing direction for enabling movement of said door in said arced path into and out of said closed position and into and out of operative relation with said locking member.

2. The dry-cleaning machine of claim 1 in which said locking lugs of said door are formed with said conical side surfaces.

3. The dry-cleaning machine of claim 2 which said door has a central axis, and said door locking lug conical side surfaces are tapered inwardly at an angle of about 5 degrees with respect to said central axis.

4. The dry-cleaning machine of claim 1 in which said locking member is a ring.

5. The dry-cleaning machine of claim 4 in which said locking ring is in threaded engagement with a forward end of said cleaning vessel.

6. The dry-cleaning machine of claim 1 in which said locking lugs extend radially from said door and locking member.

7. The dry-cleaning machine of claim 6 in which said door locking lugs extending radially outwardly of the door, and said locking member lugs extend radially inwardly of said locking member.

8. The dry-cleaning machine of claim 6 in which said locking member lugs define a plurality of circumferentially spaced recesses designed to permit passage of said door locking lugs through said recesses when said locking member is in said unlocked position, and said locking member being rotatable from said unlocked position to said locking position for locating said locking member lugs in juxtaposed locking relation to said door locking lugs.

9. The dry-cleaning machine of claim 8 including an actuator for selectively rotating said locking member between said locking and unlocked positions.

10. The dry-cleaning machine of claim 8 in which said locking member lugs each have a locking surface at an axial end thereof, said door locking lugs each being formed with said conical side surfaces and having an abutment surface at one axial end of the side surface for engaging an end of said cleaning vessel when door is in said closed position and a locking surface at an opposite axial end of the side surface for engaging a locking surface of a locking member lug when said locking member is in said locking position.

11. The dry-cleaning machine of claim 10 in which corners of said door locking lugs defined by said side surface and said abutment and locking surfaces at opposite axial ends of said side surfaces are rounded for permitting arced movement of said door locking lugs into and out of operative relation with said locking member.

12. The dry-cleaning machine of claim 10 in which said locking member recesses define side surfaces at the bottoms of the recesses, and said conical side surfaces of said door locking lugs are engageable with said locking member recessed side surfaces for camming said door into predetermined aligned relationship with said cleaning vessel as an incident to movement of said door along said arced path to said closed position.

13. The dry-cleaning machine of claim 12 in which said locking member has an annular door seating surface disposed adjacent said locking lugs, and said locking member recess side surfaces each communicate with said annular seating surface for guiding said door locking lugs onto said annular seating surface during movement of said door along said arced path to said closed position.

14. The dry-cleaning machine of claim 13 in which said tapered conical surfaces of said door locking lugs locate said door in said closed position with a relatively small clearance between said conical side surfaces and said locking member recess side surfaces with said clearance space being progressively larger in a direction toward said cleaning vessel.

15. The dry-cleaning machine of claim 13 in which said locking member locking surfaces extend from a root at said annular seating surface to a terminal tip, and said locking member and door lug locking surfaces mate with point contact at a location intermediate said terminal tip and root when said locking member is in said locking position for minimizing stress concentrations at said root.

16. The dry-cleaning machine of claim 12 in which said locking member annular door seating surface is tapered outwardly with respect to said door lug side surfaces in a direction toward the cleaning vessel.

17. The dry-cleaning machine of claim 1 in which said door opening and closing apparatus includes a pivotal frame upon which said door is mounted, said pivotal frame being pivotally movable from an upright position with said door in said closed position and an outer position which moves said door in said arced path away from said cleaning vessel.

18. The dry-cleaning machine of claim 17 in which said door lug locking surfaces have a rounded shape for engaging said locking member locking surfaces with said point contact.

19. The dry-cleaning machine of claim 17 in which said locking member locking surfaces taper outwardly away from a mating door locking surfaces in a direction toward the terminal tip thereof such that the terminal tip of the locking surface is spaced from the locking face of a door locking lug when the locking ring is in said locked position.

20. The dry-cleaning machine of claim 17 in which said point contact between said locking surfaces is about midway between said root and terminal tip.

21. The dry-cleaning machine of claim 17 in which said locking member and door lug locking surfaces define a small angle from said point contact opening in a radially outward direction with respect to said door.

22. A dry-cleaning machine comprising a cleaning vessel having a cylindrical chamber for containing a wash bath and items to be cleaned, said cleaning vessel having a removable door, a locking member for retaining said door in a closed position on said cleaning vessel, a cleaning liquid supply for selectively directing a cleaning liquid into said chamber when said door is in said closed position for use during a cleaning cycle, a door opening and closing apparatus for moving said door between said closed position and an open position for enabling items to be loaded into said chamber and removed therefrom, said door opening and closing apparatus being operable for moving said door along a non-axial path of movement with respect to the axis of said cylindrical cleaning vessel chamber away from said cleaning vessel during opening and during return movement to said closed position;

said door and locking member each having respective locking lugs, said locking member being selectively movable between a locking position in which the locking member lugs and door lugs are in aligned juxtaposed relation to each other for preventing movement of said door from said closed position and an unlocked position in which said door and locking member lugs are in offset relation to each other for permitting movement of said door from said closed position, and said locking member lugs each having a locking surface at an axial end thereof, said door locking lugs each having an abutment surface at one axial end of a side surface for engaging an end of said cleaning vessel when door is in said closed position and a locking surface at an opposite axial end of said side surface for engaging a locking surface of a locking member lug when said locking member is in said locking position, and said door locking lugs having rounded corners at the junctures of said abutment and locking surfaces with side surfaces for enabling movement of said door in said non-axial path into and out of said closed position and into and out of operative relation with said locking member.

23. The dry-cleaning machine of claim 22 in which said locking member lugs define a plurality of circumferentially spaced recesses having side surfaces at the bottom of said recesses and being designed to permit passage of said door locking lugs through said recesses when said locking member is in said unlocked position, said locking member being rotatable from said unlocked position to said locking position for locating said locking member lugs in juxtaposed locking relation to said door locking lugs, said locking member having an annular door seating surface disposed adjacent said locking lugs and in communication with said locking member recess side surfaces, and said locking member locking surfaces each extending from a rounded root at said annular seating surface to a terminal tip of the locking surface.

24. The dry-cleaning machine of claim 23 which said side surfaces of said door locking lugs locate said door in said closed position with a relatively small clearance between said side surfaces and said locking member recess side surfaces with said clearance space being progressively larger in a direction toward said cleaning vessel.

25. The dry-cleaning machine of claim 23 in which said locking member and door lug locking surfaces mate with point contact at a location intermediate said terminal tip and root when said locking member is in said locking position for minimizing stress concentrations at said root.

26. The dry-cleaning machine of claim 25 in which said locking member locking surfaces taper outwardly away from a mating door locking surfaces in a direction toward the terminal tip thereof such that the terminal tip of the locking surface is spaced from the locking face of a door locking lug when the locking ring is in said locked position.

27. The dry-cleaning machine of claim 26 in which said point contact between said locking surfaces is about midway between said root and terminal tip.

28. The dry-cleaning machine of claim 23 in which said door lug locking surfaces have a rounded shape for engaging said locking member locking surfaces with said point contact.

29. The dry-cleaning machine of claim 23 in which said locking member and door lug locking surfaces define a small angle from said point contact opening in a radially outward direction with respect to said door.

30. A dry-cleaning machine comprising:

a cleaning vessel having a cylindrical chamber for containing a wash bath and items to be cleaned;

said cleaning vessel having a removable door;

a locking member for retaining said door in a closed position on said cleaning vessel;

a cleaning liquid supply for selectively directing a cleaning liquid into said chamber when said door is in said closed position for use during a cleaning cycle;

a door opening and closing apparatus for moving said door between said closed position and an open position for enabling items to be loaded into said chamber and removed therefrom;

said door opening and closing apparatus being operable for moving said door along a non-axial path of movement with respect to the axis of said cylindrical cleaning vessel chamber away from said cleaning vessel during opening and during return movement to said closed position;

said door and locking member each having respective locking lugs, said locking member lugs defining a plurality of circumferentially spaced recesses having side surfaces at the bottom of said recesses and being designed to permit passage of said door locking lugs through said recesses when said locking member is in said unlocked position, said locking member further having an annular door seating surface disposed adjacent said locking lugs and in communication with said locking member recess side surfaces, said locking member being selectively movable between a locking position in which the locking member lugs and door lugs are in aligned juxtaposed relation to each other for preventing movement of said door from said closed position and an unlocked position in which said door and locking member lugs are in offset relation to each other for permitting movement of said door from said closed position;

said locking member lugs each having a locking surface at an axial end thereof extending from a root at said annular seating surface to a terminal tip of the locking surface, said door locking lugs each having an abutment surface at one axial end of a side surface for engaging an end of said cleaning vessel when door is in said closed position and a locking surface at an opposite axial end of said side surface for engaging a locking surface of a locking member lug when said locking member is in said locking position; and said locking member and door lug locking surfaces each mate with point contact a t a location intermediate the terminal tip and root when said locking member is in said locking position for minimizing stress concentrations at said root.

31. The dry-cleaning machine of claim 30 in which said door lug locking surfaces have a rounded shape for engaging said locking member locking surfaces with said point contact.

32. The dry-cleaning machine of claim 31 in which said locking member and door lug locking surfaces define a small angle from said point contact opening in a radially outward direction with respect to said door.

33. The dry-cleaning machine of claim 30 in which said locking member locking surfaces taper outwardly away from a mating door locking surfaces in a direction toward the terminal tip thereof such that the terminal tip of the locking surface is spaced from the locking face of a door locking lug when the locking ring is in said locked position.

34. The dry-cleaning machine of claim 30 in which said point contact between said locking surfaces is about midway between said root and terminal tip.

35. A dry-cleaning machine comprising:

a cleaning vessel having a cylindrical chamber for containing a wash bath and items to be cleaned;

said cleaning vessel having a removable door;

a locking member for retaining said door in a closed position on said cleaning vessel;

a cleaning liquid supply for selectively directing a cleaning liquid into said chamber when said door is in said closed position for use during a cleaning cycle;

a door opening and closing apparatus for moving said door between said closed position and an open position for enabling items to be loaded into said chamber and removed therefrom;

said door opening and closing apparatus being operable for moving said door along a non-axial path of movement with respect to the axis of said cylindrical cleaning vessel chamber away from said cleaning vessel during opening and during return movement to said closed position;

said door and locking member each having respective locking lugs, said locking member lugs defining a plurality of circumferentially spaced recesses having side surfaces at the bottom of said recesses and being designed to permit passage of said door locking lugs through said recesses when said locking member is in said unlocked position, said locking member further having an annular door seating surface disposed adjacent said locking lugs and in communication with said locking member recess side surfaces, said locking member being selectively movable between a locking position in which the locking member lugs and door lugs are in aligned juxtaposed relation to each other for preventing movement of said door from said closed position and an unlocked position in which said door and locking member lugs are in offset relation to each other for permitting movement of said door from said closed position;

said locking member lugs each having a locking surface at an axial end thereof extending from a root at said annular seating surface to a terminal tip of the locking surface, said door locking lugs each having an abutment surface at one axial end of a side surface for engaging an end of said cleaning vessel when door is in said closed position and a locking surface at an opposite axial end of said side surface for engaging a locking surface of a locking member lug when said locking member is in said locking position; and said door locking lug side surfaces locating said door in said closed position with a relatively small clearance between said door lug side surfaces and said locking member recess side surfaces with said clearance space being progressively larger in a direction toward said cleaning vessel.

* * * * *